US006492747B1

(12) United States Patent
Hoffmann

(10) Patent No.: US 6,492,747 B1
(45) Date of Patent: Dec. 10, 2002

(54) ELECTRIC FUSE

(75) Inventor: Volker Hoffmann, Zirndorf (DE)

(73) Assignee: Leoni Bordnetz-Systeme GmbH & Co. KG, Nuremberg (DE)

( * ) Notice: Subject to any disclaimer, the term of this patent is extended or adjusted under 35 U.S.C. 154(b) by 0 days.

(21) Appl. No.: 09/581,962

(22) PCT Filed: Dec. 19, 1998

(86) PCT No.: PCT/EP98/08340

§ 371 (c)(1),
(2), (4) Date: Aug. 11, 2000

(87) PCT Pub. No.: WO99/33079

PCT Pub. Date: Jul. 1, 1999

(30) Foreign Application Priority Data

Dec. 20, 1997 (DE) ..... 197 57 026

(51) Int. Cl.[7] ..... H01H 35/00

(52) U.S. Cl. ..... 307/131; 307/131; 337/4; 337/5

(58) Field of Search ..... 307/116, 125, 307/131; 361/104, 105; 337/4, 5, 6, 221

(56) References Cited

U.S. PATENT DOCUMENTS

| | | | | | |
|---|---|---|---|---|---|
| 2,012,215 | A | | 8/1935 | Barthe | |
| 3,488,761 | A | * | 1/1970 | Toshio et al. | 337/221 |
| 3,828,289 | A | | 8/1974 | Hickling | |
| 3,958,206 | A | * | 5/1976 | Klint | 337/160 |
| 4,023,133 | A | * | 5/1977 | Knapp, Jr. | 337/206 |
| 4,065,741 | A | * | 12/1977 | Sakamoto et al. | 337/407 |
| 4,114,968 | A | * | 9/1978 | Latassa | 445/58 |
| 4,336,521 | A | * | 6/1982 | Kozacka et al. | 337/248 |
| 4,631,626 | A | * | 12/1986 | Bohan, Jr. | 307/117 |
| 4,752,852 | A | * | 6/1988 | Ahl et al. | 361/100 |
| 4,894,633 | A | * | 1/1990 | Holtfreter | 337/201 |
| 5,014,036 | A | | 5/1991 | Komoto | |
| 5,105,178 | A | * | 4/1992 | Krumme | 337/140 |
| 5,667,711 | A | * | 9/1997 | Mody et al. | 219/481 |
| 5,760,673 | A | * | 6/1998 | Hassler et al. | 337/168 |
| 5,831,507 | A | * | 11/1998 | Kasamatsu et al. | 337/299 |
| 6,141,202 | A | * | 10/2000 | Maeckel et al. | 337/143 |

FOREIGN PATENT DOCUMENTS

| | | |
|---|---|---|
| DE | 706 948 | 6/1941 |
| DE | 37 10 510 | 10/1988 |
| DE | 44 06 533 | 12/1994 |
| DE | 195 04 561 | 8/1996 |
| DE | 195 27 997 | 2/1998 |
| EP | 0 620 575 | 10/1994 |
| EP | 0 639 844 | 2/1995 |

* cited by examiner

*Primary Examiner*—Stephen W. Jackson
*Assistant Examiner*—Sharon Polk
(74) *Attorney, Agent, or Firm*—Venable; Norman N. Kunitz

(57) ABSTRACT

The invention relates to a fuse having an input connection (1), an output connection (2) and two parallel current paths which connect both connections to one another. The current paths are namely a main current path (3) and a partial current path. The electric fuse comprises a single fuse element (5) arranged in the main current path (3). In addition, a switch (6) which is arranged inthe partial current path is provided. The switch (6) is configured in such a way that it opens when given limiting values are exceeded, said limiting values pertaining to the current flowing through the fuse and/or to the temperture of the fuse element.

19 Claims, 3 Drawing Sheets

ELECTRIC FUSE

BACKGROUND OF THE INVENTION

The invention relates to an electric fuse, in which the current interruption in the case of, for example, an overcurrent caused by a short-circuit is effected by a fusible element. Such fuses are also used, for example, to protect the high-current supply of the on-board network of motor vehicles. The input connection of the fuse is connected to the positive pole of the vehicle battery, while the output connection is connected to the on-board network.

A problem generally associated with safety fuses is their trip behavior. The length of time that passes until the fuse is tripped or the fusible element melts through is a function of, among other things, the magnitude of the overcurrent. The larger the overcurrent, the shorter the trip time. The trip time also depends on the size of the fuse or its fuse value. With the same overcurrent, a 70 A fuse, for example, trips faster than a 100 A fuse. A shortening of the trip time—which is not only desired for vehicle electrical systems—through the use of weaker fuses is, however, impossible due to the associated danger of faulty tripping in conventional fuses.

A further problem is that, due to high-resistance line connections, for example, or a defective or inadequately-charged battery, the current flowing across the fuse does not suffice to melt the fusible element, or the current is too low to effect the melt-through in a sufficiently short time. The electrical system is consequently damaged.

SUMMARY OF THE INVENTION

Based on these conditions, it is the object of the invention to provide an electric fuse that exhibits an improved trip behavior.

This object generally is accomplished according to the invention by a fuse arrangement wherein two parallel current paths, namely a main current path and a partial current path, which connect the input and output connections of the fuse to one another, and a single fusible element and a switch are provided. The single fusible element is disposed in the main current path, and the switch is disposed in the partial current path. The switch is designed to open when predetermined limit values of the current flowing through the fuse, and/or the temperature of the fusible element, are or is exceeded. Whereas, in conventional fuses having a fusible element, the entire current flows off across the fusible element, according to the invention, the current is divided. The current flowing by way of the main current path or the fusible element is reduced by the amount of current flowing by way of the partial current path. Thus, a fuse having a lower fuse value can be inserted into the main current path. If, for example for protecting a consumer or an on-board network, a 100 A fuse is required, an 80 A fuse can be used if the partial current path is designed such that 20% of the total current flows off via the partial current path.

With the same current value, the trip time in a weaker fuse is less than in a stronger fuse. The switch of the partial current path is designed to open in the event of an overcurrent caused by, for example, a short-circuit in the electrical system. When the switch is opened, the entire overcurrent flows off via the fusible element. Because, however, the embodiment according to the invention allows the fusible element to have a lower fuse value than is normally required, the trip time is shortened relative to the strong fuse that is otherwise used. Finally, a fuse according to the invention attains the same effect as a fuse having a lower fuse value than is necessary; in this case, however, the risk of faulty trips is eliminated.

The switch in the partial current path can essentially be embodied to open when either a predetermined current value, or a predetermined maximum temperature of the fusible element, is exceeded. Both parameters—temperature and current value—can, however, also be used simultaneously as criteria for the opening of the switch. Bimetal switches, semiconductor switches or switching elements referred to as a "polyswitch," whose resistance increases sharply when the switch is heated, are examples of suitable switches.

The safety fuse and the switch disposed in the partial current path are arranged sandwich-style, particularly if the opening criterion for the switch is the temperature of the fusible element, with the switch and the fusible element resting against one another with two contact surfaces and being in thermal contact.

Generally, the elements that are preferably used are those that automatically re-close after the fusible element has melted through or cooled. Examples of such switches include the aforementioned switches, e.g., bimetal switches, semiconductors and polyswitch elements. In a motor vehicle, the advantage is that, if the current supply of the on-board network has failed due to a short-circuit, a layman is typically incapable of replacing the defective fuse with a new one. This is because the high-load fuses of a motor vehicle are usually only accessible to auto mechanics. The failure of the on-board network takes critical vehicle functions, such as the hazard-light system or the like, out of operation. If, however, the switch re-closes after the fuse has melted through, the on-board network is supplied with current after the short-circuit has been remedied. The current flowing across the switch is reduced due to the increased resistance of the partial current path. The current is usually sufficient, however, to restore devices such as the hazard-light system or an on-board telephone to operation.

If a sustained short-circuit occurs in the on-board network, a thermosensitive switch will re-open after a certain period of time when an excessive current flows by way of the partial current path. If, however, the source of the short-circuit is remote, an uninterrupted supply is available to the on-board network, which is only the case in conventional fuse systems after the fusible element has been replaced.

Special advantages are attained with the use of a microprocessor. The microprocessor can control the switch, for example. The switch therefore need not be thermosensitive. The temperature of the fusible element can be detected by a thermosensor and reported to the microprocessor, which actuates the switch if a temperature limit value is exceeded. It is also conceivable for the fuse to include a current-measurement device, which transmits the value of the present total current flowing through the fuse to the microprocessor, which actuates the switch if a limit current value is exceeded. A further advantage of the use of a microprocessor is that it can be connected to the testing and monitoring system of a vehicle. Thus, it is conceivable, for example, that the switch is also opened simultaneously if an airbag is triggered in order to attain the earliest-possible melt-through of the fusible element in the event of a short-circuit in the on-board network. Finally, a microprocessor can be used, for example, to detect a temperature increase in the region of the input or output connection of the fuse, with the aid of a thermosensor. If the aforementioned connections exhibit an increased temperature, for example due to corrosion because of an excessive resistance, this can be reported to the driver by way of a display in the dashboard, so he is forewarned and can begin looking for an auto mechanic shop.

The invention is described in detail by way of an embodiment illustrated in the attached drawings.

DESCRIPTION OF THE PREFERRED EMBODIMENTS

Figure 1:
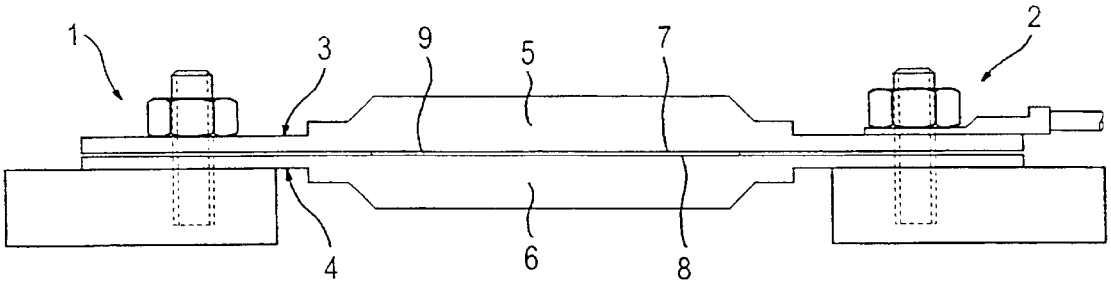
FIG. 1 schematically shows a fuse according to the invention.

As ensues from FIG. 1, a fuse according to the invention includes an input connection 1, an output connection 2, two parallel current paths, specifically a main current path 3 and a partial current path or bypass 4, which are disposed between the two connections, and a fusible element 5 and a switch 6. The fusible element 5 is disposed in the main current path 3, and the switch 6 is disposed in the bypass 4. The fusible element 5 and the switch 6 form a sandwich-like component, bordering one another with two contact surfaces 7, 8. In the case of a thermosensitive switch, this embodiment serves to facilitate the transfer of heat from the fusible element 5 to the switch 6. In principle, however, the thermal coupling can be effected in an arbitrary fashion. It can be advantageous, for example, to dispose a thermal coupling element 9, e.g., in paste or film form, between the fusible element 5 and the switch 6, the coupling element connecting the contact surfaces 7 and 8.

In principle, the technical embodiment of the switch can be arbitrary. It need only be embodied such that it opens when a limit current value or a limit temperature is exceeded.

Figure 2:
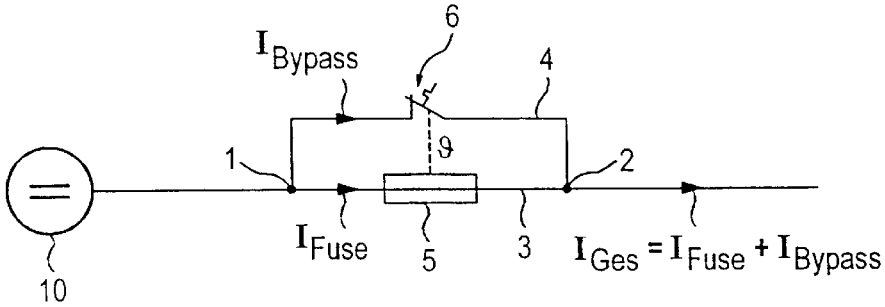
FIG. 2 is an equivalent circuit diagram of the fuse with the switch closed.
Figure 3:
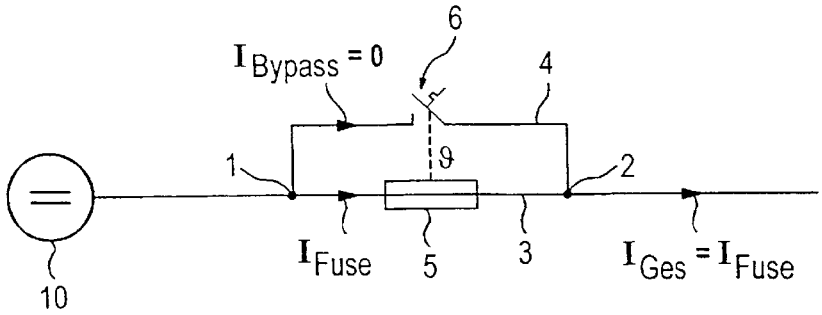
FIG. 3 is an equivalent circuit diagram of the fuse with the switch opened.
Figure 4:
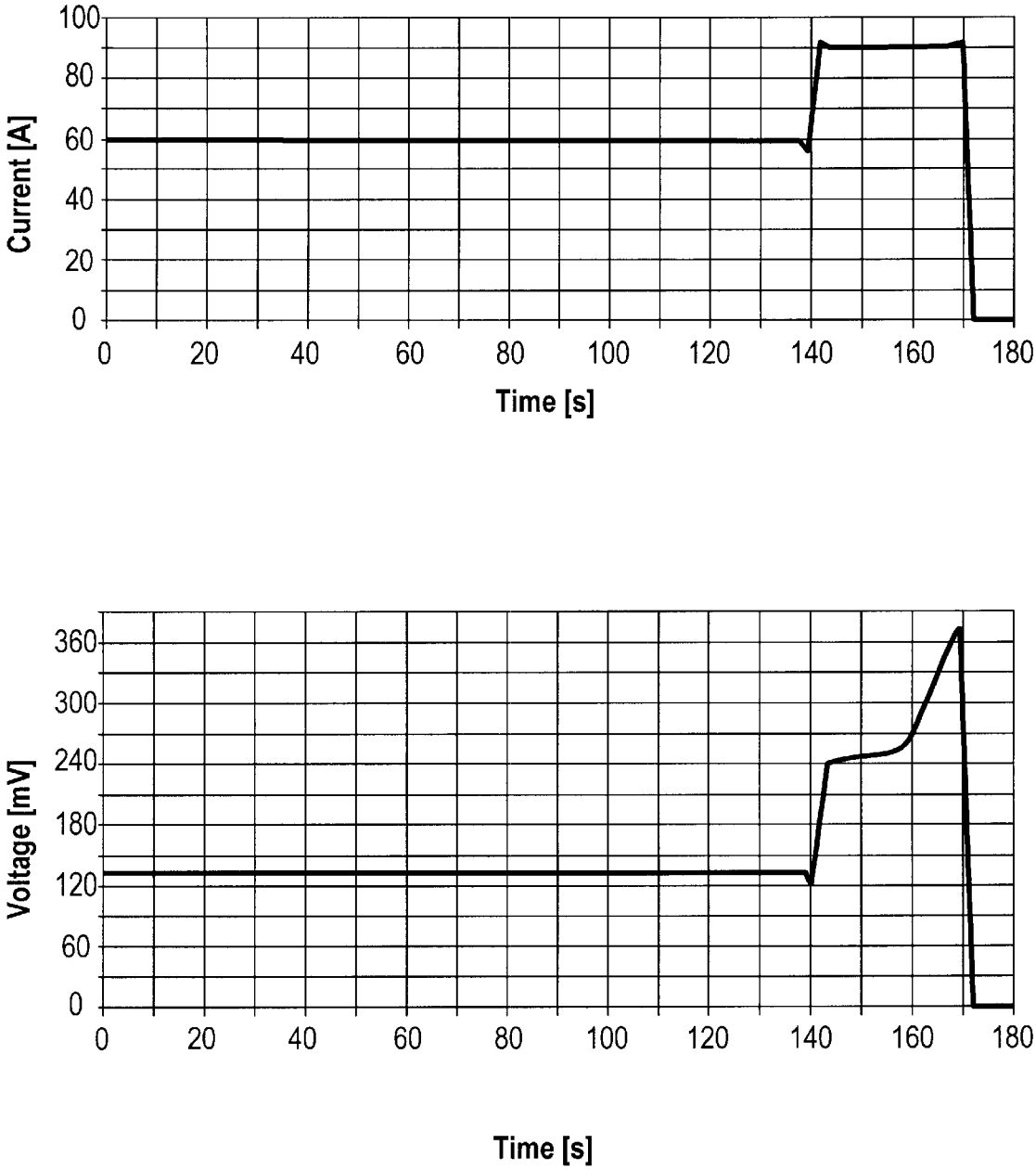
FIG. 4 shows diagrams depicting the trip behavior of a fuse according to the invention.

The illustrations in FIGS. 2 through 4 explain the function of a fuse according to the invention: The fusible element 5 is intact in the initial state of the fuse, and assures a connection between the input connection 1 and the output connection 2 by way of the main current path 3. The switch 6, a thermo sensitive switch of the aforementioned type, normally is closed. The current $I_{ges}$ received from a current source 10, such as a vehicle battery, is divided into the partial currents $I_{Bypass}$ and $I_{Fuse}$ The division is essentially selected such that the partial current flowing by way of the bypass is lower than the current flowing by way of the main current path 3.

The diagrams shown in FIG. 4 are based on measurements taken at a fuse, with the use of a 60 A safety fuse having an average inertia. The measurements were taken with an ambient temperature of about 25° C. and an overcurrent of 90 A. The resistances of the partial current paths 3 and 4 were selected such that 60 A flow by way of the main current path 3, and 30 A flow by way of the bypass 4. With the selected experiment parameters, a temperature that effects the opening of the switch 6 is attained in the fusible element 5 after about 140 seconds. After the switch has been opened (FIG. 3, t=140 in FIG. 4), the partial current $I_{Bypass}$ also flows by way of the main current path, so now 90 A flow off through the fusible element. The fuse specified for 60 A is now loaded with 90 A, which leads to a rapid melt-through within about 30 seconds.

Figure 5:
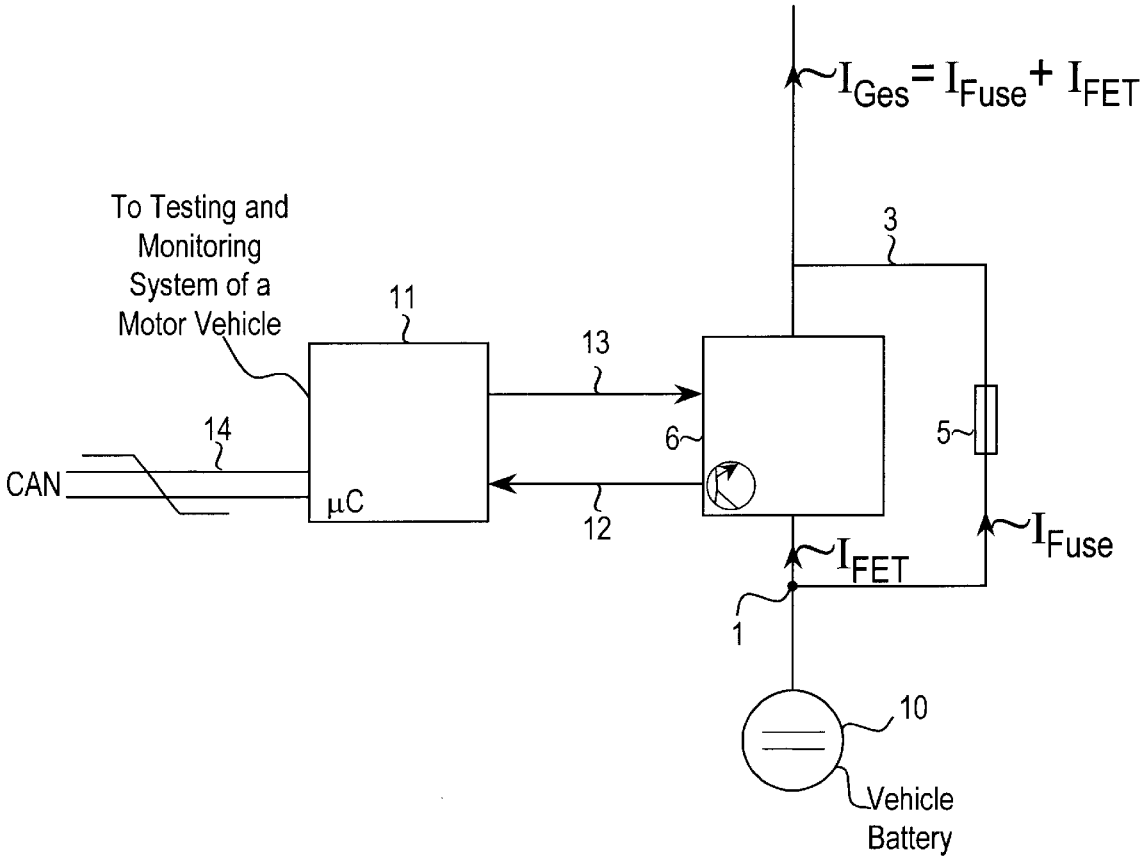
FIG. 5 is a circuit diagram of a fuse having microprocessor control.

FIG. 5 is a schematic circuit diagram of a fuse having an integrated microprocessor 11. The switch 6 is a semiconductor element, which is connected, for example via two signal lines 12, 13, to the microprocessor 11. The switch 6 is thermosensitive, and is in direct thermal contact with the fusible element 5. The status report on the current temperature of the fusible element is effected by way of the signal line 12. The switch 6 is actuated by way of the signal line 13. The microprocessor is connected to the bus system 14 of the testing and monitoring system of a motor vehicle. In this way, vehicle-specific data can be used as parameters for opening the switch 5. For example, in the event of a triggered airbag, the switch 6 is opened as a prophylactic measure. The same is true if the vehicle is nose-down. It is also conceivable to mount thermosensors in the region of the connections 1, 2 for detecting an unacceptable heating of the connections 1, 2 due to, for example, an increase in resistance because of corrosion.

Generally, it can be advantageous not to draw the quantity of heat necessary to heat the thermosensitive switch solely from the fusible element itself, but from regions adjoining the fuse, primarily the region of the input and output connections 1, 2. If need be, a thermal contact between the switch and the fusible element can be avoided entirely, in which case the aforementioned connection regions or other regions of the fuse serve as a heat source for the switch.

What is claimed is:

1. An electric fuse having an input connection, an output connection, two parallel current paths, namely a main current path and a partial current path, which connect the two connections to one another, a single fusible element and a normally closed switch, with the single fusible element being disposed in the main current path and the switch being disposed in the partial current path, and with the switch being designed to open when at least one of predetermined limit values of the current flowing through the fuse, and the temperature of the fusible element, is exceeded.

2. The fuse according to claim 1, wherein a resistance of the partial current path is such that at least 10% of the total current flows by way of the partial current path.

3. The fuse according to claim 1, wherein the switch is a switch that re-closes following a separation of the fusible element caused by a short-circuit.

4. The fuse according to one of claim 1, wherein the single switch and the fusible element form a sandwich construction, with the switch and the fusible element being in thermal contact with one another with two contact surfaces.

5. The fuse according to one of claim 1, further comprising a microprocessor that is connected via signal lines to the switch, and particularly controls opening and closing of the switch.

6. The fuse according to claim 5, wherein the temperature of the fusible element that is detected by a temperature sensor and is transmitted to the microcompressor and used as a switching criterion for actuating the switch.

7. The fuse according to claim 5, wherein the microprocessor is connected, on an input side, to a testing and monitoring system of a motor vehicle.

8. The use of a fuse according to claim 1 to protect an electrical on-board network of a motor vehicle.

9. An electric fuse having an input connection, an output connection, two parallel current paths, namely a main current path and a partial current path, which connect the two connections to one another, a single fusible element and a normally closed switch, with the single fusible element being disposed in the main current path and the switch being disposed in the partial current path, and means for directly detecting the temperature of the fusible element and for opening the switch when a predetermined limit value for the temperature of the fusible element is exceeded.

10. The fuse according to claim 9, wherein the means for sensing additionally senses the current flowing through the fusible element and opens the switch when limit values of at least one of the temperature of the fusible element and the current flowing through the fusible element are exceeded.

11. The fuse according to claim 10, wherein a respective fraction of the total flowing current flows through each of the main and partial current paths; and the resistance of the partial current path is such that the fraction of the total current flowing through the partial current path is less than the fraction of the total current flowing through the main current path.

12. The fuse according to claim 11, wherein the resistance of the partial current path is such that at least 10% of the total current flows through the partial current path.

13. The fuse according to claim 10, wherein the switch is of the type that re-closes following opening of the fusible element.

14. The fuse according to claim 10, wherein: the switch and the fusible element are individual elements arranged adjacent one another in a sandwich construction; the switch is thermo sensitive and opens in response to the predetermined temperature limit; and the means for directly detecting includes adjacent respective surfaces of the switch and of the fusible element that are in thermal contact with one another.

15. The fuse according to claim 10, wherein the means for detecting and for opening includes a microprocessor that is connected via signals lines to the switch, and at least partially controls the opening of the switch.

16. The fuse according to claim 15, wherein the means for directly detecting the temperature of the fusible element includes a temperature sensor disposed to detect the temperature of the fusible element and for transmitting a signal corresponding thereto to the microprocessor, which uses the signal as a switching criterion for actuating the switch.

17. The fuse according to claim 15, wherein an input of the microprocessor is connected to a testing and monitoring system of a motor vehicle.

18. The fuse according to claim 15 wherein the microprocessor additionally is responsive to signals received from the testing and monitoring system to cause opening of the switch.

19. An electrical on-board network of a motor vehicle including a fuse according to claim 9 for protection of the network.

* * * * *